United States Patent [19]

Takao et al.

[11] 3,956,571

[45] May 11, 1976

[54] METHOD FOR MAKING ELECTROSTATIC RECORDING SHEET AND RESULTING PRODUCT

[75] Inventors: Katsuji Takao, Nishinomiya; Koji Otsubo, Kobe, both of Japan

[73] Assignee: Kanzaki Paper Manufacturing Co., Ltd., Tokyo, Japan

[22] Filed: July 1, 1975

[21] Appl. No.: 592,181

[30] Foreign Application Priority Data

July 4, 1974 Japan ..... 49-77090

[52] U.S. Cl. ..... 428/513; 427/121; 427/209; 428/511; 428/514; 428/537

[51] Int. Cl.[2] ..... B05D 5/12

[58] Field of Search ..... 427/121, 209; 428/513, 428/514, 411, 537, 511

[56] References Cited

UNITED STATES PATENTS 3,672,982 6/1972 Travers ..... 428/514

3,674,896 7/1972 Purcell et al. ..... 428/511

*Primary Examiner*—Cameron K. Weiffenbach

*Attorney, Agent, or Firm*—Armstrong, Nikaido & Wegner

[57] ABSTRACT

An electrostatic recording sheet is produced by coating the opposite surfaces of a paper sheet with an electroconductive coating composition including a cationic polymer electroconductive agent and a cationic sizing agent to form electroconductive layers and further coating one of said electroconductive layers with a dielectric coating composition in the form of an aqueous polymer dispersion to form a recording layer via a penetration resist layer. The penetration resist layer is formed of a gelated material produced by an ionic reaction on contact of said aqueous polymer dispersion with said electroconductive layer.

8 Claims, No Drawings

METHOD FOR MAKING ELECTROSTATIC RECORDING SHEET AND RESULTING PRODUCT

BACKGROUND OF THE INVENTION

This invention relates to an improved electrostatic recording sheet and to a method for making the same, and more especially, to an improved method for making an electrostatic recording sheet having superior recording properties by coating directly on an electroconductive base sheet a coating composition consisting essentially of an aqueous dispersion of polymers to form a dielectric layer.

The electrostatic recording system has recently been widely applied to a facsimile or a computer input-output system suitable for high speed recording in a high speed telecommunication system, a high speed graphic reproduction system, etc. The electrostatic recording material as a recording medium basically comprises a highly dielectric layer, which serves as an electric-charge-retentive layer, and an electroconductive base sheet which supports the dielectric layer. Electrostatic images of electrical signals formed on the dielectric layer are made visible with a developer comprising a toner and a carrier which has a polarity opposite to the polarity of the electrostatic image charge, and fixed as permanent visible images by further treatment.

It is known to use high molecular substances such as polystyrene, polyacrylates, polyvinylidene chloride, polyvinyl acetate, polyvinyl acetal, nitrocellulose and silicone resin for forming such a dielectric layer. Usually these high molecular substances are applied onto a base sheet in the form of solutions prepared by being dissolved into an organic solvent such as acetone, toluene, benzene, methylethyl ketone and the inflammability Use of such organic solvents is disadvantageous because of their inflamability and poisonous characters when vaporized in addition to the fact that they are usually expensive.

In order to avoid these disadvantages with organic solutions some attempts have been made to use aqueous coating compositions to form the dielectric layer on a base sheet. In this case, however, the treatment for reducing an electric resistivity of the base sheet is usually carried out by coating or size press impregnating conventional highly hydrophilic electroconductive agents such as hygroscopic inorganic salts, hygroscopic polyalcohols, activators of quaternary ammonium polyelectrolytes and the like, consequently the electroconductive agent on the surface of the base sheet or in the base sheet dissolves and migrates into the aqueous coating composition to result in degrading the electrostatic characteristics of the dielectric layer. Thus, using such aqueous compositions involves fatal defects such as deterioration in its charging retentive and dielectric properties.

Another attempt has also been made to form a barrier layer between an electroconductive layer and a dielectric layer to prevent migration of the electroconductive agent into the dielectric layer. However, this involves an economical disadvantage for the additional step therefor and a functional defect that the recording sensitivity is lowered due to an increase in the thickness of the dielectric layer.

It is disclosed in U.S. Pat. No. 3,861,954 to prevent penetrating of the electroconductive agent into a base sheet by using a dense paper sheet having a bulk porosity of less than 200 Sheffield units as measured by a Sheffield Porosimeter with a 1½ inch orifice and air at 1½ psi. as base sheet for forming an electrostatic recording material with an aqueous composition, to form relatively thin layer of an electroconductive agent on the dense paper base sheet and then to form a dielectric layer on said thin layer of an electroconductive agent. This method, because of using a special dense paper base sheet having the low Sheffield porosity as base sheet, is advantageous in that a uniform layer of an electroconductive agent can be formed, but preparation of the base sheet is troublesome because it is necessary to blend pulps in a certain special manner and to carry out high-level mechanical refining of used pulps to obtain such base sheet. Further, increasing the density of a base sheet inevitably involves deteriorating the dimensional stability to make the base sheet curly.

Additionally, in the method disclosed in U.S. Pat. No. 3,861,954 with the amount of the electroconductive agent in excess of 0.5 g/m², the obtained electroconductive layer exhibits a poor sizing degree because of high hydrophilic property of the electroconductive agent, and the aqueous coating composition for forming the dielectric recording layer penetrates instantaneously into the layer of the electroconductive agent to result in forming an ununiform dielectric recording layer. Such a recording sheet with an ununiform dielectric recording layer is liable to get an increased electric capacity, a reduced charging potential and irregular charging. Accordingly, such a recording sheet cannot get uniform density of recorded images.

On the other hand, with the electroconductive agent below 0.5 g/m², only a minimum amount of the electroconductive agent penetrates into the dielectric layer so that the insulating properties of the dielectric layer is kept in relatively good condition. However, the amount of the electroconductive agent used is so small that the conductivity of the electroconductive layer is deteriorated under low humidity conditions and no satisfactory images can be produced on the recording sheet, although relatively good imges can be produced under mild as well as high humidity.

The principal object of the invention is to provide an improved method for making an electrostatic recording sheet wherein an aqueous coating composition of highly insulating synthetic resin can be directly applied onto the base sheet which has been subjected to an electroconductive treatment in such a manner that the above mentioned various disadvantages with the prior art can be overcome.

Other objects and advantages of the invention will become apparent from the following description.

SUMMARY OF THE INVENTION

According to the invention the opposite surfaces of a paper sheet are coated with an electroconductive coating composition essentially consisting of at least one cationic polymer electroconductive agent and at least one cationic sizing agent to form electroconductive layers on the opposite surfaces of said paper sheet. One of the electroconductive layers is coated with a specific anionic coating composition to form a dielectric recording layer thereon.

The specific anionic coating composition consists essentially of an aqueous dispersion including a. 100 parts by weight of at least one water-insoluble polymer prepared from at least one monomer selected from the group consisting of ethylenic monomers, such as olefines, aromatic vinyl compounds, alkylacrylates, alkylmethacrylates and vinyl halides, and conjugated diolefinic monomers, and b. 20 to 200 parts by weight of at least one water-soluble salt of polymer containing carboxyl groups.

According to the invention, a thin penetration resist layer is incidentally formed between the electroconductive layer and the dielectric recording layer. The penetration resist layer is formed of a gelated material produced by an ionic reaction occurred on contact of said aqueous dispersion of anionic materials with said electroconductive layer made of cationic materials.

In a preferred embodiment of the invention, the paper sheet is sized by the electroconductive coating composition including a cationic sizing agent so as to have an alkali sizing degree of at least 10 seconds. As to the definition of the alkali sizing degree, a detailed description will be given hereinafter.

The amount of the cationic sizing agent in the electroconductive coating composition should be within the range of 5 to 100 parts by weight, more preferably, 20 to 60 parts by weight, with respect to 100 parts by weight of the cationic polymer electroconductive agent coexisting in the electroconductive coating composition.

The electroconductive coating composition may preferably be applied to the paper sheet by the size press technique.

The incidentally formed thin penetration resist layer of a gelated material between the electroconductive layer and the dielectric recording layer functions as an effective barrier for preventing migration of the electroconductive agent into the dielectric recording layer.

Coexistence of a cationic sizing agent in the electroconductive coating composition reduces the moisture sensitivity or higroscopicity with the result that the obtained recording sheet may always find its usefulness whatever moisture conditions.

DETAILED DESCRIPTION OF THE INVENTION

Preferably, the cationic polymer electroconductive agent included in the electroconductive coating composition is a polyelectrolyte having an ammonium, sulfonium or phosphonium group as a functional group. Among the polymeric electrolytes, there are included ammonium salts such as polyethyleneimine hydrochloride, poly(N-methyl-4-vinyl pyridinium chloride), poly(2-methacryloyloxy ethyl trimethyl ammonium chloride), poly(2-hydroxy-3-methacryloyloxy propyl trimethyl ammonium chloride), poly(N-acrylamide propyl-3-trimethyl ammonium chloride), poly(N,N-dimethyl-3,5-methylene piperidinium chloride), polyvinyl trimethyl ammonium chloride, polyallyl trimethyl ammonium chloride, polyvinyl benzyl trimethyl ammonium chloride, etc; sulfonium salts such as poly(2-acryloxyethyldimethyl sulfonium chloride), etc. and phosphonium salts such as poly(glycidyl tributyl) phosphonium chloride, etc. The most preferred among the above ammonium, sulfonium and phosphonium salts is ammonium salts.

Further, among ammonium salts, those having a quaternary ammonium group as a functional group are more preferred. Among typical quaternary ammonium salts, poly(2-methacryloyloxy ethyl trimethyl ammonium chloride), poly(N-acrylamide propyl-3-trimethyl ammonium chloride), poly(N,N-dimethyl-3,5-methylene piperidinium chloride), polyallyl trimethyl ammonium chloride and polyvinyl benzyl trimethyl ammonium chloride are most preferred. In the quaternary ammonium salts the percentage of quaternized basic nitrogen groups with respect to the total quaternized and unquaternized basic nitrogen groups may preferably be within the range of 40 to 80%, most preferably be within the range of 50 to 75%. If the quaternized rate is smaller than 40%, the required electroconductivity would not be obtained. Quaternary ammonium polyelectrolytes having a quaternized rate higher than 80% is difficult to obtain and disadvantageous in that is highly hydrophilic property allows the electroconductive agent to migrate into the dielectric recording layer, penetrating the penetration resist layer of a gelated material.

The average molecular weight of quaternary ammonium polyelectrolytes cannot be fixed but it may be within the range of 2,000 to 100,000 preferably, within the range of 3,000 to 50,000.

The cationic sizing agent which coexists in the electroconductive coating composition according to the invention may preferably be selected from such water-soluble ones as disclosed in U.S. Pat. No. 2,964,445, namely, salts of linear chain copolymers of (1) at least one monomer containing a $CH_2{=}C<$ group having an attached substituent containing a hydrocarbon radical of at least 6 carbon atoms with (2) a monoethylenically unsaturated monomer copolymerizable with said (1) and having a substituent containing a basic nitrogen group which is converted to a hydrophilic salt.

Among the monomers containing a $CH_2=C<$ group having an attached substituent containing a hydrocarbon radical of at least 6 carbon atoms, there may be included aromatic hydrocarbons having an olefinic substituent such as vinyl benzene, vinyl toluenes, vinyl naphthalenes, etc.; esters of $\alpha$ or $\beta$ unsaturated monocarboxylic acids having 3 to 6 carbon atoms such as acrylic acid, $\alpha$-ethyl acrylic acid, methacrylic acid, etc. with aromatic or aliphatic primary alcohols having 6 to 18 carbon atoms such as benzyl alcohol, etc. or partly esterified compounds of higher fatty acids with higher alcohols such as stearic acid monoglyceride, stearic acid monoester of ethylene glycol, etc.; esters of aliphatic or aromatic monocarboxylic acid having at least 6 carbon atoms such as caproic acid, caprylic acid, capric acid, lauric acid, palmitic acid, stearic acid, benzoic acid, toluic acids, naphthenic acids, naphtholic acids, phenyl acetic acid and the like with aliphatic unsaturated alcohols having 2 to 4 carbon atoms such as vinyl alcohol and the like.

On the other hand, among the monoethylenically unsaturated monomers being copolymerizable with monomer (1) and having a substituent containing a basic nitrogen changeable to hydrophilic salt, there may be included olefin-substituted heterocyclic compounds having a basic ring nitrogen such as vinyl pyridines, vinyl quinolines and the like; esters of lower $\alpha$, $\beta$-unsaturated monocarboxylic acids with tertiary alkamines such as dimethylaminoethyl acrylate, dimethylaminoethyl methacrylate, 2-dimethylamino-1-methylethyl acrylate or methacrylate and the like; dialkylaminoalkyl amides such as dimethylaminoethyl acrylamide and the like.

Partial or complete conversion of the basic nitrogen groups into hydrophilic salts can be carried out by reaction with water-soluble acids such as acetic acid, hydrochloric acid and the like, but it is more preferable to change the basic nitrogen groups into quaternary ammonium salts by alkyl halides such as benzyl chloride, butyl bromide and the like.

The copolymerization mol ratio range of said monomers containing a hydrophobic group to said monomers containing a hydrophilic group cannot be defined because it depends on kinds of monomers, the conversion ratio of the basic nitrogen groups into quaternary ammonium salts and required hydrophilic and hydrophobic properties of the obtained copolymers. But the preferable range of said copolymerization mol ratio is generally 1:1 to 15:1, and more preferable 1:1 to 10:1. The desirable conversion ratio of the basic nitrogen groups into quaternary ammonium salts is within the range of 30 to 90%.

These salts of the copolymers may be used solely, but they may also be used with the other compounds such as melamine resin, urea resin, etc. which are usually mixed in the conventional sizing agents in order to control the viscosity, water repellency and the like. It is also allowed to modify them by epoxy groups and the like to increase the reactivity of the sizing agents so far as the required characters as the sizing agent are not lost.

The above mentioned copolymer salt sizing agents have a good compatibility with a coexistent cationic electroconductive agent. To the contrary, such sizing agents of an emulsion type as prepared by emulsifying paraffin wax, petroleum resin and the like are not suitable for use in carrying out the present invention because they show a poor compatibility with the cationic electroconductive agent described and frequently repel the anionic aqueous dispersion described, when coated thereon, with the result of forming spotted dielectric recording layer.

According to the invention the electroconductive coating composition including both the cationic polymer electroconductive agent and the cationic sizing agent described in the above is applied to the opposite surfaces of a paper sheet to form electroconductive layers. The paper sheet, per se, may be of any conventional type. Neither particular treatment such as extremely strong beating nor particularly selected pulp blend is required in preparing the base paper sheet. Usual paper materials for electrostatic recording sheets and various coated papers can be used for the invention.

The base paper sheet after having had an electroconductive treatment with use of the above mentioned coating composition may preferably have a surface resistivity within the range of $10^5$ to $10^9$ ohm.

In a preferred embodiment of the invention, the paper sheet after having had the electroconductive treatment has an alkali sizing degree of at least 10 seconds. The alkali sizing degree is measured by a method similar to that described in JIS-P-8122. Namely, a sample paper sheet having had an electroconductive treatment is floated on an aqueous solution of 0.001N NaOH(pH=11.13) in a Petri's dish at 20°C and 60% RH and then immediately an indicator (thymol blue) is put on the surface of the floating paper sheet. The alkali sizing degree is determined by the time in seconds required until a few blue points appear on the floating paper sheet. The alkali sizing degree thus measured changes according to the thickness of the sample paper sheet. Accordingly, a relative alkali sizing degree is calculated by the following formula $$y = \left(\frac{60}{x}\right)^2 t$$

wherein $y$ is the relative alkali sizing degree by seconds, $x$ is the weight of the sample paper by g/m² and $t$ is the actually measured alkali sizing degree by seconds. The alkali sizing degree described in this specification indicates the above relative alkali sizing degree.

Coexistence of a cationic sizing agent in the electroconductive coating composition aims to lower the moisture-sensitivity or hygroscopicity of the electroconductive layer formed as well as to control the production of a gelated material so as to form a uniform penetration resist layer on the contact surface of the electroconductive layer with the dielectric recording layer. Adjustment of the sizing degree of the base paper sheet after having had an electroconductive treatment is therefor of a great importance. If the relative sizing degree of the base paper sheet is smaller than 10 seconds, the moisture-sensitivity or hygroscopicity of the electroconductive layer cannot be lowered as desired and the anionic polymer aqueous dispersion will drastically migrate into the electroconductive layer with the result that a uniform recording layer cannot be obtained.

The rate of the amount of the sizing agent to the amount of the electroconductive agent can be varied depending on their respective kinds. Generally speaking, however, the amount of the sizing agent should be within the range of 5 to 100 parts by weight, more preferably, 20 to 60 parts by weight, with respect to 100 parts by weight of the electroconductive agent. If the amount of the sizing agent is larger than 100 parts by weight with respect to 100 parts by weight of the electroconductive agent, the surface resistivity of the electroconductive layer cannot be controlled within the range of $10^5$ to $10^9$ ohm as required. If the amount of the sizing agent is smaller than 5 parts by weight with respect to 100 parts by weight of the electroconductive agent, the alkali sizing degree of the base paper sheet would become smaller than 10 seconds.

The electroconductive coating compositions may further include inorganic and organic pigments such as clay, kaolin, calcium carbonate, barium sulfate, polystyrene, polyethylene and the like, pigment dispersing agents such as various phosphates and the like, natural or synthetic viscosity controlling agents such as starch, polyvinylalcohol, methyl cellulose and the likes, dyes and other additional agents. It should, however, be noted that those additional agents must not be anionic ones and the amount of each of these additional agents must be within such the range that the addition of those agents does not degrade the electroconductive and sizing properties of the coating composition.

The electroconductive coating composition including the electroconductive agent and the sizing agent is applied to the opposite sides of the base paper sheet by any of conventional techniques such as size press technique or by utilizing an air-knife-coater, roll coater, blade coater and the like. Among those coating techniques the size press technique is most preferred because the coating composition can be applied to the paper immediately after the step of manufacturing paper and at the opposite sides of the paper simultaneously.

There is no particular limitation for the amount of the electroconductive coating composition applied so far as both the required surface resistivity of $10^5$ to $10^9$ ohm and the required alkali sizing degree higher than 10 seconds can be obtained, most frequency, the electroconductive coating composition is applied in such a manner that the amount of the electroconductive agent is within the range of 0.75 to 2.5 g/m², preferably, 0.8 to 2.0 g/m² on dry basis on each of the surfaces.

Aqueous dispersions of polymers described in Japanese Pat. No. 727,360 are used preferably as aqueous dispersions of anionic polymers coated on base sheet with such an electroconductive treatment to form a dielectric recording layer.

In aqueous dispersions of anionic polymers, among ethylenic monomers to prepare water-insoluble polymers there are linear or branched olefines having 2 to 25 carbon atoms such as ethylene, propylene, butylene, etc.; aromatic vinyl compounds such as styrene, vinyl toluene, halogen-substituted styrenes, etc; acrylic or methacrylic esters having alkyl group of 1 to 12 carbon atoms such as butyl acrylate, methyl methacrylate, etc.; vinyl halides such as vinyl chloride, vinylidene chloride, etc. and the like, as conjugated diolefinic monomers, there are diolefines having 4 to 10 carbon atoms such as butadiene, isoprene, chloroprene, piperylene and the like. The most preferable monomers are alkyl acrylates, alkyl methacrylates, aromatic vinyl compounds such as styrene, and conjugated diolefines such as butadiene.

As the water-soluble salts of polymers having carboxyl groups which act as anion to form gelation with cationic electroconductive materials and dispersing agent for the water-insoluble polymers into water, there may be included ammonium or organic amine salts of copolymers of ethylenic monomers such as ethylene, styrene, vinyl toluene, acrylates, methacrylates, vinyl halides, halogen-substituted styrenes, etc, with unsaturated carboxylic acids such as acrylic acid, methacrylic acid, crotonic acid, itaconic acid, maleic acid, fumaric acid, etc. or monoesters of dicarboxylic acids such as itaconic acid, maleric acid, fumaric acid, etc.; ammonium or organic amine salts of copolymers of conjugated diolefines such as butadiene, isoprene, piperylene, chloroprene, cyclopentadiene, etc. with said unsaturated caboxylic acids or monoesters of dicarboxylic acids; and ammonium or organic amine salts of copolymers of said ethylenic monomers and said conjugated diolefines with said unsaturated carboxylic acids or monoesters of dicarboxylic acids.

Though such water-soluble polymers having carboxylic groups may be prepared by emulsion polymerization, suspension polymerization or solution polymerization of monomers as described above, solution polymerization is preferable from the viewpoint of stability.

The useful contents of caboxyl group in the polymer are within the range of 8 to 50%, because polymers contaning less than 8 mol % of carboxyl group become slightly water-soluble or water-insoluble not to obtain stable aqueous dispersion, and polymers containing more than 50 mol % of carboxyl group reduce electrostatic characteristics of the obtained electrostatic recording sheet at high humidity.

In an aqueous dispersion, at least 20 parts by weight of said water-soluble salt of polymer should be used to 100 parts by weight of water-insoluble polymer to get sufficient gellation with cationic layer of electroconductive material. However, if the rate of the amounts of the water-soluble salt of polymer to the water-insoluble polymer becomes larger, gelation will easily occur but the fluidity of the aqueous dispersion coating composition is lowered and the hygroscopic property of the dielectric recording layer will be increased with the result that the electrostatic properties are lowered under a relatively high humidity. Practically, the upper limit of the amounts of water-soluble salt of polymer are desirable to be less than 200 parts by weight with respect to 100 parts by weight of water-insoluble polymer.

The anionic polymer aqueous dispersion used for the invention may be prepared either by polymerizing or copolymerizing at least one monomer selected from ethylenic monomers and conjugated diolefinic monomers with said water-soluble salts of polymer with or without using of an emulsifier, or by polymerizing or copolymerizing said monomers with use of an emulsifier and then adding thereto water-soluble salts of polymer, or polymerizing or copolymerizng said monomers under the existence of water-soluble salts of polymer and optionally adding thereto an emulsifier, or by polymerizing or copolymerizing said monomers by the solution polymerization technique and then dispersing the polymerized or copolymerized product into water with use of water-soluble salts of polymer and, if necessary, an emulsifier. The anionic polymer aqueous dispersion may further include finely divided, non-conductive and non-photo conductive inorganic or organic powder such as clay, kaolin, calcined clay, calcium carbonate, barium sulfate, polystyrene and etc. Those powders may be added to the dispersion after coating by a hydrophobic substance such as silicone resin and etc. Addition of those finely divided powders is useful to produce mat finishing paper having a good writing property.

The aqueous dispersion may further includes dispersing agents such as phosphates, sodium alkyl naphthalene sulphonate and the like, viscosity controlling agents such as polyvinyl alcohol, carboxymethyl cellulose, gum arabic, alginates, gelatin and the like, plasticizers, dyes, anti-foaming agent and other additional agents which are widely used in the production of electrostatic recording papers. It should, however, be noted that the amount of each of those additional agents must be within such the range that the addition of those agents does not degrade the electrostatic properties of the aqueous dispersion.

The coating composition mainly consisting of an anionic polymer aqueous dispersion may be applied to the base sheet after having had an electroconductive treatment with use of a conventional coater such as air-knife-coater, roll coater and etc. The amount of the coating composition applied may be preferably within the range of 3 to 20 g/m², more preferably, 5 to 10 g/m² on dry basis.

PREFERRED EMBODIMENT OF THE INVENTION

The following examples serve to illustrate the invention in more detail although the invention is not limited to the examples. Unless otherwise indicated, parts and percentages are all by weight.

EXAMPLE 1

A raw paper base sheet of 60g/m² basis weight was formed from a blend pulp comprising 30 parts NBKP (bleached soft wood kraft pulp, Canadian Standard Freeness, 500cc) and 70 parts LBKP (bleached hard wood kraft pulp, Canadian Standard Freeness, 500cc), and containing the additives of 1 part rosin and 2 part aluminum sulfate. This base sheet was then size press-coated on the opposite sides, with a mixture of 75 parts polyvinyl benzyl trimethyl ammonium chloride (average molecular weight: 11000, quaternized rate: 60%) as an electroconductive agent, 25 parts sizing agent made by copolymerization of methyl methcacrylate and 2-methacryloyloxy ethyl trimethyl ammonium chloride with the mol ratio being 5 : 1 and 25 parts clay, and dried to obtain electroconductive layers each having 2.5 g/m² by drying weight. The alkali sizing degree of thus treated base sheet was 23 seconds.

On the other hand, an aqueous ammoniacal dispersion of polymers having a solid content of 25% was prepared with 100 parts copolymer consisting of 20% butadiene and 80% styrene and 100 parts aqueous copolymer consisting of 30% butadiene, 55% methyl methacrylate and 15% methacrylic acid. Said aqueous dispersion was coated on said treated base sheet by an air-knife-coater and dried to obtain an electrostatic recording sheet with 6g/m² dielectric recording layer by drying weight.

The electrostatic recording sheet had a uniform water-insoluble gel to form a thin penetration resist layer on the contact surface of said electroconductive layer with said dielectric recording layer.

A latent image was formed on said electrostatic recording sheet using a single stylus recording head having a line density of 6 lines per mm by pulse signals of −800V, 50 micro seconds under 20°C, 60%RH, and developed by magnetic brushing method with toner to obtain a very clear recording image.

Control 1

Example 1 was repeated, but instead of using the cationic electroconductive agent and sizing agent, they were replaced by 75 parts polystyrene sodium sulfonate (average molecular weight : 3000, sulfonation rate: 70%) and 25 parts anionic sizing agent being random copolymer consisting of methylmethacrylate and partly neutralizated methacrylic acid (sodium salt) to obtain an electroconductive-treated base sheet. The alkali sizing degree of this treated base sheet was 25 seconds. Further, with said treated base sheet, an electrostatic recording sheet was prepared as in Example 1.

In this obtained electrostatic recording sheet, there did not occur gelation at the contact surface of the electroconductive layer with the recording layer, so that the density of the recording image was very poor when recorded with the same method and conditions as in Example 1, owing to dissolution and migration of the electroconductive agent into the dielectric recording layers. Accordingly, thus obtained recording sheet was practically useless.

EXAMPLES 2 to 8

The same base sheets as in Example 1 were size press-coated on the both sides with the mixture of the same cationic sizing agent as in Example 1 and various electroconductive agents as indicated in Table 1 and dried to obtain electroconductive-treated base sheets having electroconductive layers at the opposite sides each having 2 g/m² by drying weight.

Various electrostatic recording sheets were prepared as in Example 1 except in using said treated base sheets. Latent images were formed on them as in Example 1 and developed by toner, so that very clear images could be obtained on every recording sheets because of preventing dissolution and migration of the electroconductive agents into the dielectric recording layers with uniform gelation to form a thin penetration resist layer at the contact surfaces of the electroconductive layers with dielectric recording layers.

Controls 2 to 4

Three electroconductive-treated base sheets and electrostatic recording sheets were prepared as in Example 2 except changing the mixing ratio of the electroconductive agent to the sizing agent.

In Controls 2 and 3, although water-insoluble gels were formed at the contact surfaces of the electroconductive layers with the recording layers, uniform recording layers were not obtained because of remarkable penetration of the aqueous coating composition into the electroconductive layers owing to the low alkali sizing degrees. On the base sheet in Control 4, a satisfactory electroconductivity was not obtained.

Accordingly, when they were recorded as in Example 1, the recording sheets obtained in Controls 2 and 3 grew extremely irregular charging and the density of recording images was very reduced, and the recording sheet obtained in Control 4 was shown high background density at low humidity, so all of them were practically useless.

EXAMPLES 9 to 13

In every examples, the same base sheet as in Example 1 was size press-coated on the both sides with the mixture of 70 parts polyvinyl benzyl trimethyl ammonium chloride, 30 parts cationic sizing agent as indicated in Table 2 and 100 parts kaolin and dried to obtain the treated base sheet having electroconductive layers at the opposite surfaces each having 2.5 g/m² by drying weight.

Various electrostatic recording sheets were prepared as in Example 1 except using said treated base sheets. Latent images were formed on them as in Example 1 and developed by toner, so that very clear images were obtained on all of them.

Control 5

A size press-coating composition was prepared as in Example 9 except using a sizing agent of emulsion type which was made by emulsifying paraffin wax. But, because of bad compatibility of said sizing agent to the electroconductive agent, precipitates were grown in said coating composition and satisfactory electroconductive treatment could not be carried out.

Further, when the same aqueous coating compositon as in Example 1 was coated on the base sheet treated by said size press-coating composition, the aqueous coating composition was partly repelled not to obtain uniform dielectric recording layer.

EXAMPLE 14

An coating composition containing mainly an aqueous ammoniacal dispersion of 35% solid consisting of 100 parts copolymer of 15 mol % butadiene and 85 mol % styrene, 50 parts copolymer of 30 mol % butadiene, 10 mol % styrene, 45 mol % methylmethacrylate and 15 mol % methacrylic acid, and 70 parts clay coated with organopolysiloxane was coated on the surface of the same electroconductive-treated base sheet as in Example 1 by air-knife coater and dried to obtain an electrostatic recording sheet having 8 g/m² recording layer by drying weight. This electrostatic recording sheet formed a uniform water-insoluble gel to form thin a penetration resist layer at the contact surface of the electroconductive layer with the recording layer.

An electrostatic latent image was formed by usual electrophotographic process on a photosensitive plate comprising an aluminum sheet and a photosensitive layer of sensitized polyvinylcarbazole. The recording surface of dielectric layer of the electrostatic recording sheet prepared above was brought into intimate contact with the latent image bearing surface of the photosensitive plate. The rear surfaces of the two were short-circuited and then the recording sheet was separated from the plate to transfer the latent image onto the dielectric layer. Subsequently, the latent image on the recording sheet was made visible with a known developer of the wet type. Consequently, a clear transfer image having high density was obtained. Further, the surface of the dielectric recording layer had appearance as general papers used for office work and superior characteristic for writing and stamping.

EXAMPLES 15 to 21

Coating compositions containing mainly the aqueous dispersion of anionic polymers consisting various compositions as indicated in Table 3 were coated by air-knife coater on the surfaces of the electroconductive-treated base sheets as in Example 1 and dried to obtain electrostatic recording sheets having 6 g/m² recording layer by drying weight. In every case, uniform water-insoluble gels to form the thin penetration resist layers were formed at the contact surfaces of electroconductive layers with recording layers to result in preventing the dissolution of electroconductive agents into the dielectric recording layers. Accordingly when the latent images were produced by the same process as in Example 1 and developed with toner, extremely clear images were obtained.

Control 6

An aqueous ammoniacal dispersion containing 100 parts copolymer of 80 mol % styrene and 20 mol % butadiene, 10 parts copolymer of 30 mol % butadiene, 55 mol % methylmethacrylate and 15 mol % methacrylic acid and 2 parts polyoxyethylene lauryl ether was coated on the surface of the same treated base sheet as in Example 1 and dried to obtain an electrostatic recording sheet having 6 g/m² dielectric recording layer by drying weight.

Though water-insoluble gel was formed a little at the contact surface the recording layer with the electroconductive layer in thus obtained recording sheet, the penetration of the electroconductive agent into the dielectric recording layer was recognized not to obtain a uniform recording layer because said coating composition did not contain any aqueous polymer having satisfactory amount of carboxyl group. Accordingly, when the recording sheet was recorded as in Example 1, irregular charging occurred all over and the density of recording images was reduced. So, thus obtained recording sheet was practically useless.

TABLE 1

| | Electroconductive Agent | | | Mixture Ratio (Parts by Weight) | | | |
|---|---|---|---|---|---|---|---|
| | Compound | Average Molecular Weight | Quaterized Rate (%) | Electroconductive Agent | Sizing Agent | Alkali Sizing Degree | Recording Image |
| Example 2 | Polyvinylbenzyl trimethyl ammonium chloride | 11,000 | 60 | 50 | 50 | 32 | Good |
| Example 3 | " | " | " | 70 | 30 | 25 | Good |
| Example 4 | " | " | " | 90 | 10 | 12 | Good |
| Example 5 | Poly(N-acrylamide propyl-3-trimethyl ammonium chloride) | 8,000 | 65 | 70 | 30 | 21 | Good |
| Example 6 | Poly(2-methacryloyloxy ethyl trimethyl ammonium chloride) | 8,000 | 63 | 70 | 30 | 20 | Good |
| Example 7 | Polyallyl trimethyl ammonium chloride | 18,000 | 69 | 70 | 30 | 16 | Good |
| Example 8 | Poly(N,N-dimethyl-3,5-methylene piperidinium chloride) | 12,000 | 70 | 70 | 30 | 18 | Good |
| Control 2 | Polyvinyl benzyl trimethyl ammonium chloride | 10,000 | 73 | 100 | 0 | 2 | Poor |
| Control 3 | " | " | " | 96 | 4 | 8 | Poor |
| Control 4 | " | " | " | 40 | 60 | 36 | Poor |

TABLE 2

| | Cationic Sizing Agent (Copolymerization Molar Ratio) | Alkali Sizing Degree (Seconds) | Recording Image |
|---|---|---|---|
| Example 9 | Copolymer of styrene and 2-methacryloyloxy ethyl dimethyl benzyl ammonium chloride (5:1) | 24 | Good |
| Example 10 | Copolymer of laurylmethacrylate and N-methyl-4-vinyl pyridinium chloride (7:1) | 26 | Good |
| Example 11 | Copolymer of vinylnaphthalene and N-benzyl-4-vinylpyridinium chloride (7:1) | 23 | Good |
| Example 12 | Copolymer of styrene and stearyl methacrylate and 2-methacryloyloxy ethyl trimethyl ammonium chloride (2:1:1) | 25 | Good |
| Example 13 | Copolymer of vinyl toluene and | 22 | Good |

TABLE 2-continued

| Cationic Sizing Agent (Copolymerization Molar Ratio) | Alkali Sizing Degree (Seconds) | Recording Image |
|---|---|---|
| N-butyl-2-methyl-4-vinyl pyridinium chloride (4:1) | | |

TABLE 3

| | Coating Composition Composition | Parts by Weight | Recording Image |
|---|---|---|---|
| Ex. 15 | Copolymer of butadiene and styrene (20:80) | 100 | Good |
| | Copolymer of butadiene and methylmethacrylate and methacrylic acid (30:55:15) | 20 | |
| | Polyoxyethylene lauryl ether (HLB=17) | 2 | |
| Ex. 16 | Copolymer of butadiene and styrene (20:80) | 100 | Good |
| | Copolymer of butadiene, methylmethacrylate and methacrylic acid (30:55:15) | 150 | |
| | Calcium carbonate | 80 | |
| Ex. 17 | Copolymer of butadiene and styrene (20:80) | 100 | Good |
| | Copolymer of butadiene, methylmethacrylate and methacrylic acid (30:55:15) | 200 | |
| | Calcined clay | 100 | |
| Ex. 18 | Polystyrene | 50 | Good |
| | Copolymer of butadiene and styrene (60:40) | 50 | |
| | Copolymer of butadiene, styrene, methylmethacrylate and methacrylic acid (20:20:30:30) | 100 | |
| Ex. 19 | Copolymer of butadiene and styrene (20:80) | 100 | Good |
| | Copolymer of styrene and acrylic acid (70:30) | 30 | |
| Ex. 20 | Copolymer of vinyl chloride and methylmethacrylate (40:60) | 100 | Good |
| | Copolymer of styrene, methylmethacrylate and methacrylic acid (20:65:15) | 50 | |
| Ex. 21 | Polymer of butylacrylate | 100 | Good |
| | Copolymer of styrene butadiene, methylmethacrylate and methacrylic acid (25:25:25:25) | 70 | |

What we claim is:

1. A method for making an electrostatic recording sheet comprising:

coating the opposite surfaces of a paper sheet with an electroconductive coating composition essentially consisting of at least one cationic polymer electroconductive agent and at least one cationic sizing agent to form electroconductive layers, further coating one of said electroconductive layers with an anionic coating composition to form a dielectric recording layer with incidental formation of a thin penetration resist layer between said electroconductive layer and said dielectric recording layer, said anionic coating composition consisting essentially of an anionic aqueous dispersion including a. 100 parts by weight of at least one water-insoluble polymer prepared from at least one monomer selected from the group consisting of ethylenic monomers, such as olefines, aromatic vinyl compounds, alkylacrylates, alkylmethacrylates and vinyl halides, and conjugated diolefinic monomers, and b. 20 to 200 parts by weight of at least one water-soluble salt of polymer containing one carboxyl groups, and said penetration resist layer being formed of a gelated material produced by an ionic reaction on contact of said anionic aqueous dispersion with said cationic electroconductive layer.

2. A method for making an electrostatic recording sheet according to claim 1, in which said paper sheet is sized by said electroconductive coating composition including said cationic sizing agent so as to have an alkali sizing degree of at least 10 seconds.

3. A method for making an electrostatic recording sheet according to claim 1, in which the amount of said cationic sizing agent in said electroconductive coating composition is 5 to 100 parts by weight with respect to 100 parts by weight of said cationic polymer electroconductive agent.

4. A method for making an electrostatic recording sheet according to claim 3, in which the amount of said cationic sizing agent in said electroconductive coating composition is 20 to 60 parts by weight with respect to 100 parts by weight of said cationic polymer electroconductive agent.

5. A method for making an electrostatic recording sheet according to claim 3, in which said electroconductive coating composition is applied to said paper sheet by the size press technique.

6. A method for making an electrostatic recording sheet according to claim 1, in which said cationic polymer electroconductive agent is a polyelectrolyte having an ammonium, sulfonium or phosphonium group as a functional group.

7. A method for making an electrostatic recording sheet according to claim 1, in which said cationic polymer electroconductive agent is a polyelectrolyte having a quaternary ammonium group as a functional group.

8. An electrostatic recording sheet comprises a paper sheet, electroconductive layers formed on the opposite surfaces of said paper sheet, a dielectric recording layer formed on one of said electroconductive layers, and an penetration resist layer formed between said dielectric layer and said one of electroconductive layers, said recording sheet being the product produced by the process of claim 1.

* * * * *

UNITED STATES PATENT OFFICE

CERTIFICATE OF CORRECTION

Patent No. 3,956,571 Dated May 11, 1976

Inventor(s) KATSUJI TAKAO ET AL

It is certified that error appears in the above-identified patent and that said Letters Patent are hereby corrected as shown below:

Column 1, lines 35 and 36, "inflammability" should read -- like --.

Col. 7, line 54, correct "caboxyl" to --carboxyl--.

Col. 7, line 56, change "50%" to --50 mol %--.

Signed and Sealed this

Twenty-first Day of December 1976

[SEAL]

*Attest:*

RUTH C. MASON
*Attesting Officer*

C. MARSHALL DANN
*Commissioner of Patents and Trademarks*